US005427066A

United States Patent [19]

Buckley et al.

[11] Patent Number: 5,427,066

[45] Date of Patent: Jun. 27, 1995

[54] FUEL SYSTEM

[75] Inventors: Paul Buckley; John R. Jefferson, both of Rainham; Peter A. G. Collingborn; Michael P. Cooke, both of Gillingham, all of United Kingdom

[73] Assignee: Lucas Industries Public Limited Company, Solihull, United Kingdom

[21] Appl. No.: 303,696

[22] Filed: Sep. 9, 1994

[30] Foreign Application Priority Data

Sep. 14, 1993 [GB] United Kingdom ..... 9318963
Sep. 14, 1993 [GB] United Kingdom ..... 9318969

[51] Int. Cl.[6] ..... F02N 17/00
[52] U.S. Cl. ..... 123/179.17; 123/447
[58] Field of Search ..... 123/450, 447, 506, 179.17; 417/462

[56] References Cited

U.S. PATENT DOCUMENTS

| | | | |
|---|---|---|---|
| 3,759,239 | 9/1973 | Regneaultetal | 123/32G. |
| 4,083,345 | 4/1978 | Davis | 123/179.17 |
| 4,310,291 | 1/1982 | Green | 123/179.17 |
| 4,401,082 | 8/1983 | LeBlanc | 123/447 |
| 4,522,174 | 6/1985 | Babitzka | 123/450 |
| 4,601,274 | 7/1986 | Seilly | 123/447 |
| 4,625,694 | 12/1986 | Adey | 123/450 |
| 4,831,991 | 5/1989 | Cayot | 123/506 |
| 5,005,548 | 4/1991 | Rembold | 123/447 |
| 5,078,113 | 1/1992 | Haag | 123/447 |
| 5,078,114 | 1/1992 | Haag | 123/179.17 |
| 5,363,824 | 11/1994 | Bonse | 123/506 |

*Primary Examiner*—Carl S. Miller
*Attorney, Agent, or Firm*—Jacobson, Price, Holman & Stern

[57] ABSTRACT

A fuel system for supplying fuel to a compression ignition engine includes an accumulator in which fuel is stored at high pressure. The fuel being supplied to the accumulator from a high pressure cam actuated pump which includes pumping plungers operable in timed relationship with the associated engine. The apparatus also includes a distributor member having a delivery passage which can register with outlet ports in turn. Valve means is provided and this is operable in a first setting to connect the high pressure pump to the delivery passage so that fuel is supplied at a low rate to the associated engine and a second setting in which the accumulator is connected to the delivery passage to achieve a high rate of fuel delivery to the engine.

4 Claims, 5 Drawing Sheets

FUEL SYSTEM

This invention relates to a fuel system for supplying fuel to the injection nozzles in turn of a multi-cylinder compression ignition engine, the system including an accumulator in which fuel is stored under pressure, means including a delivery passage for distributing fuel to the injection nozzles in turn, valves means operable to connect said accumulator with said delivery passage when it is required to supply fuel to the engine and pump means for charging the accumulator.

An accumulator based fuel system has the advantage over a conventional cam actuated plunger pump system in that it is possible to provide an ideal fuel pressure at all engine speeds and loads unlike a plunger based system.

It is well known that benefits are obtained by supplying an initial quantity of fuel to the combustion chamber of a compression ignition engine at a reduced rate followed by the main quantity of fuel at an increased rate and the object of the present invention is to provide a fuel system of the kind specified in a form in which the initial flow of fuel to the engine can be controlled.

According to the invention in a fuel system of the kind specified said pump means comprises a cam actuated plunger pump which is driven in timed relationship with the associated engine and said valve means has a first setting in which the output of the cam actuated plunger pump is directed to the delivery passage so as to deliver fuel to the engine at a reduced rate, the valve means having a second setting in which the accumulator is connected to the delivery passage to provide an increased rate of fuel delivery to the engine.

Figure 1:
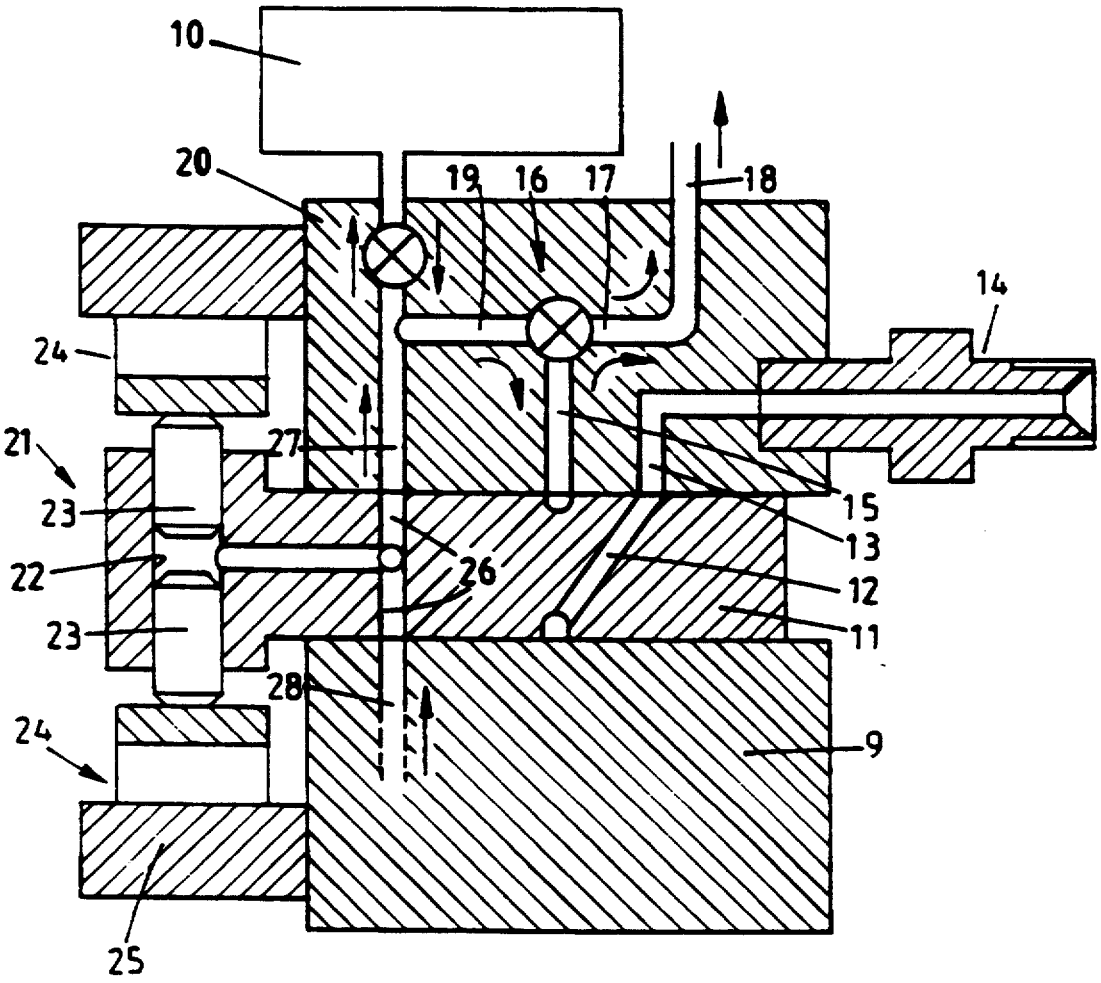
Figure 2:
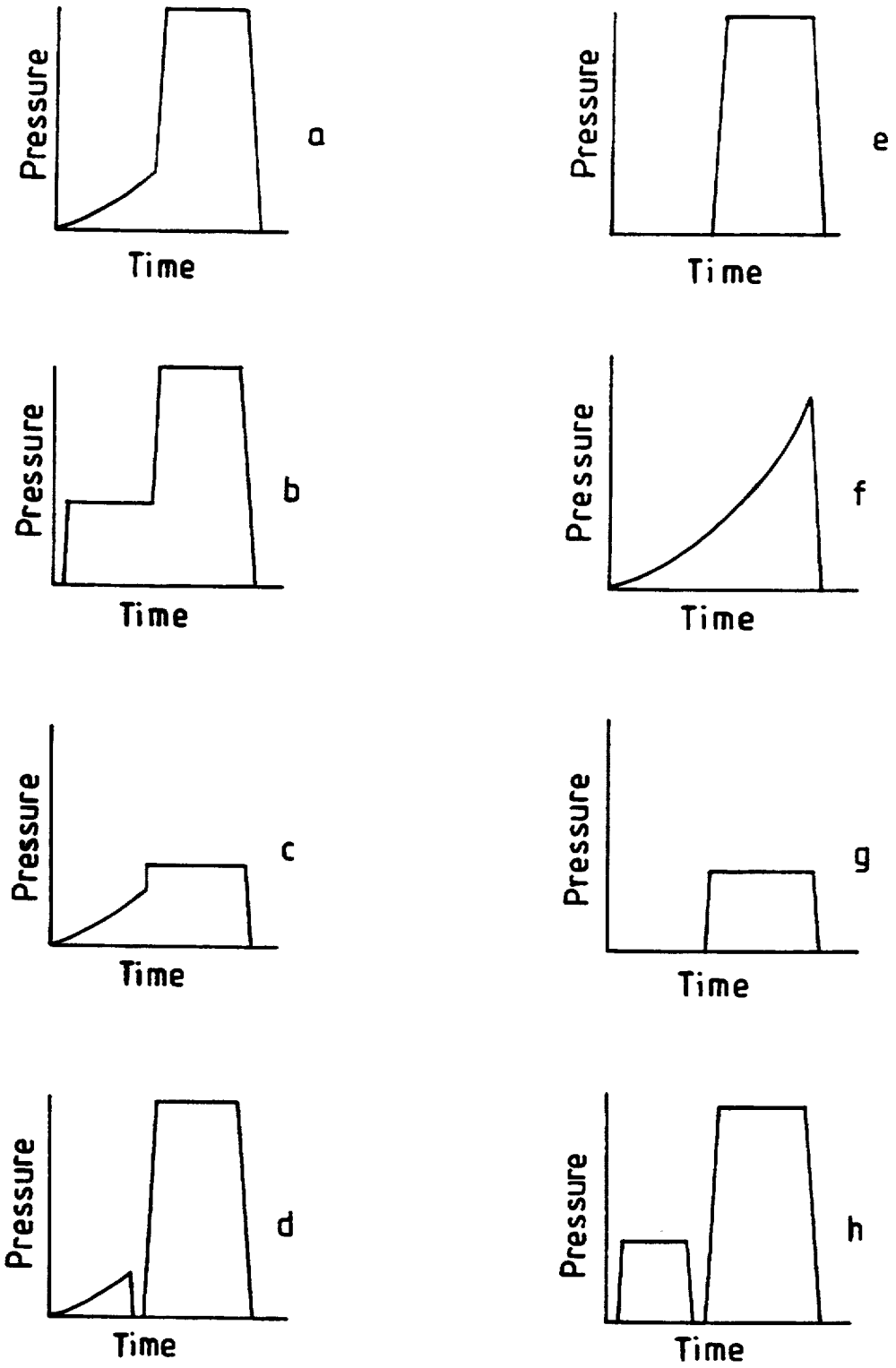
Figure 3:
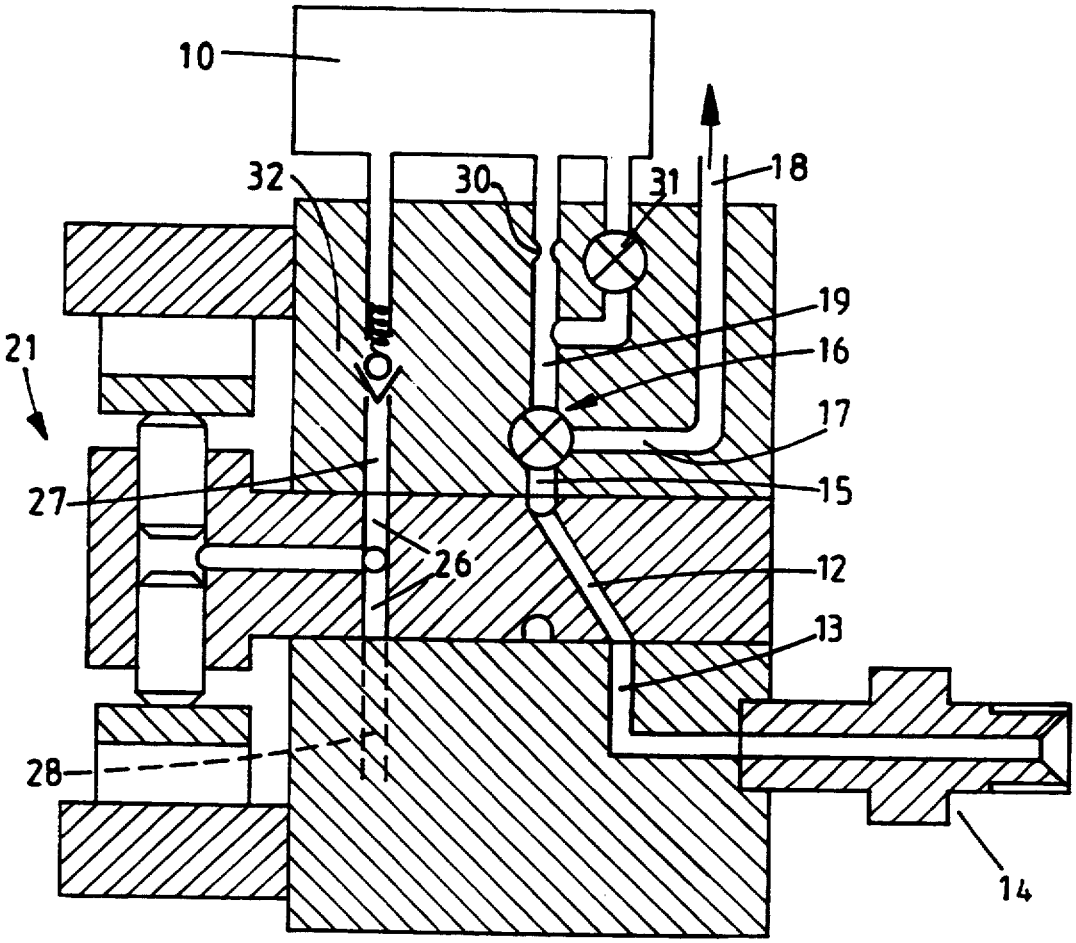
Figure 4:
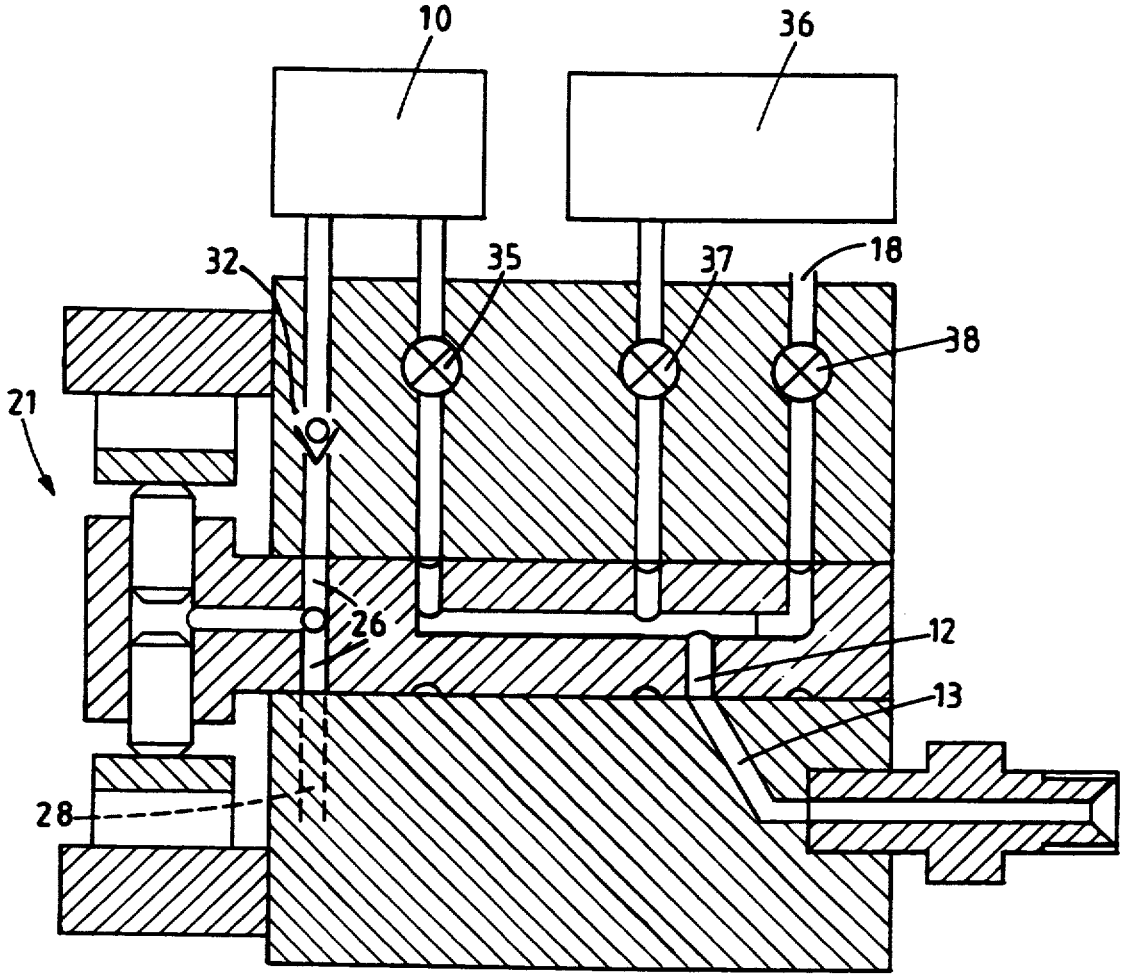
Figure 5:
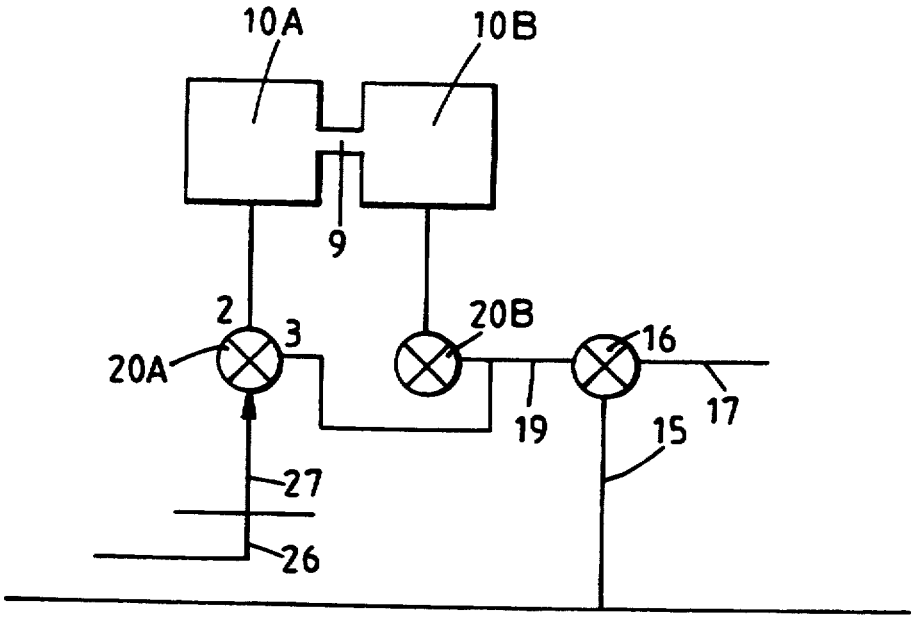
Figure 6:
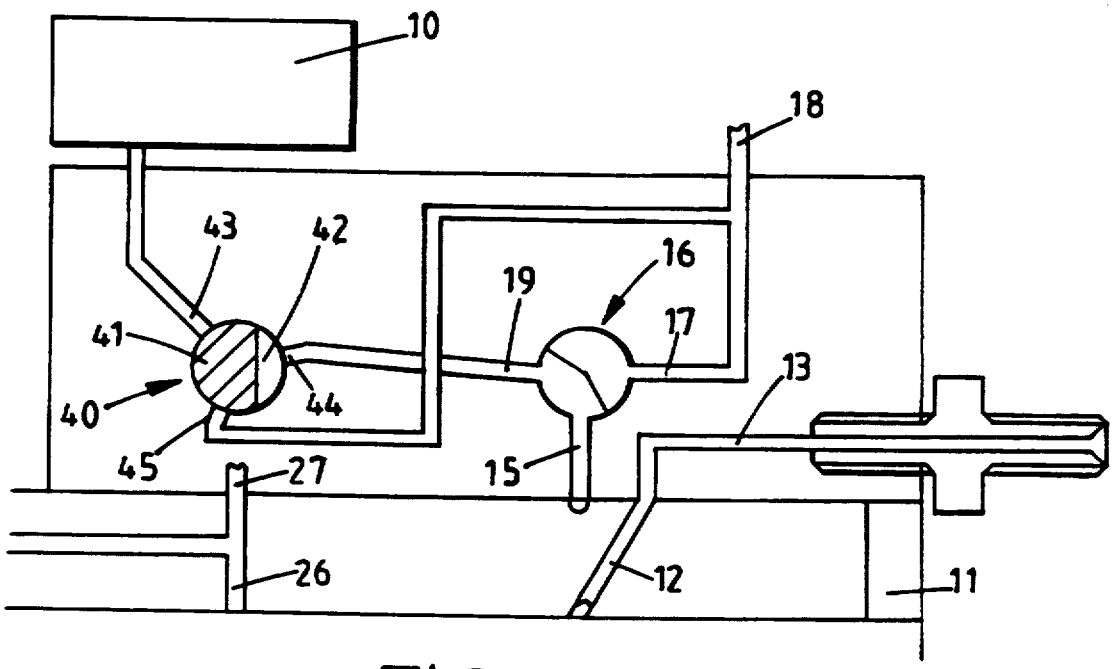

Examples of systems in accordance with the invention will now be described with reference to the accompanying drawings in which:

FIG. 1 is a sectional side elevation of one example of part of a fuel system in accordance with the invention, FIG. 2 is shows various fuel injection rate diagrams which can be obtained from the systems described herein, FIGS. 3 and 4 show alternative forms of fuel system, and FIGS. 5 and 6 show modifications to the system shown in FIG. 1 with FIG. 6 showing a series A–E of valve positions.

Referring to FIG. 1 of the drawings there is shown at 10 an accumulator in which liquid fuel is stored at a pressure which is sufficiently high to open the fuel pressure actuated valve members of the fuel injection nozzles of the associated engine.

In order to charge the accumulator and also to distribute fuel from the accumulator to the injection nozzles in turn there is provided a pump/distributor unit which comprises a body 9 in which is journaled a rotary cylindrical distributor member 11. The distributor member is driven in timed relationship with the associated engine by means of a drive shaft not shown. Formed in the distributor member is a delivery passage 12 and this can register in turn with a plurality of outlet ports 13 which are formed in the body and which are connected to outlets 14 respectively the outlets in use being connected to the injection nozzles respectively of the associated engine. Each outlet may be provided with the usual form of delivery valve. The passage 12 communicates with a circumferential groove formed in the periphery of the distributor member and this groove is in constant communication with a common port 15 of a two way valve 16. The valve has a further port 17 which is connected to a drain passage 18 and a still further port 19 which is connected through an ON/-OFF valve 20 to the accumulator 10. The valves 16 and 20 are conveniently electrically actuated the electrical power being supplied from a control system which is responsive to various engine operating parameters and a desired operating parameter.

In order to charge the accumulator a high pressure pump generally indicated at 21 is provided and this comprises a transverse bore 22 formed in a portion of the distributor member which extends from the body 9. Slidably mounted in the bore is a pair of pumping plungers 23 which at their outer ends, engage cam followers 24 respectively each cam follower including a roller which engages the internal peripheral surface of an annular cam ring 25. The cam ring is provided in the case of an engine having four cylinders, with four equi-angularly spaced cam lobes which impart inward movement to the plungers as the distributor member is rotated. An additional pair of plungers may be provided and these would be located in a further bore which for the application described would intersect the bore 22 at right angles. For a six cylinder engine the further bore would be located in a plane spaced from the plane containing the bore 22 by 60° and the cam ring would have six cam lobes.

For a five cylinder engine the cam ring would be provided with five cam lobes and five plungers may be provided in individual bores or three plungers may be provided again in individual bores with appropriate spacing of the bores and with one plunger being larger than the other two in order to achieve balance of the forces acting on the distributor member.

Returning to the example, the portion of the bore 22 which lies intermediate the plungers is connected to four equi-angularly spaced passages 26 which open onto the periphery of the distributor member so as to register in turn with a transfer port 27. The transfer port is connected to a point intermediate the valves 16 and 20. In addition, the passages 26 can register in turn with a fuel supply port 28 this port being connected to the outlet of a low pressure pump. This pump may have a rotary part carried by the distributor member 11 or the rotary part of the pump may be driven directly by the drive shaft.

Ignoring for the moment the action of the high pressure pump 21 and assuming that the accumulator 10 is charged with fuel. As the distributor member rotates the delivery passage 12 will move into register with an outlet port 13. Before this communication is established the valve 16 is placed in a first position in which the ports 15 and 19 are in communication with each other the port 17 therefore being effectively closed. When delivery of fuel is required the valve 20 is opened and fuel from the accumulator then flows through the valves 20 and 16 and to the selected outlet 14. When sufficient fuel has been supplied to the engine the valve 16 is switched to its second position in which the port 19 is closed, and the port 15 is connected to the port 17. This connection causes a reduction of the fuel pressure within the port 15 and the delivery passages and the outlet port 13 so that the valve in the associated fuel injection nozzle can close quickly. As the distributor member further rotates the passage 12 moves out of register with the outlet port 13 and prior to the next delivery of fuel the valves are switched so that the valve 20 is closed and the valve 16 is in its first position in which the ports 15 and 19 are interconnected. Thus the valve 20 controls the supply of fuel from the accumulator and determines the start of delivery of fuel to the engine and the valve 16 serves to terminate the supply of fuel to the engine.

Considering now the operation of the high pressure pump 21. The main purpose of this pump is to charge the accumulator with fuel but in the particular example it may also be used to supply an initial quantity of fuel to the engine at a reduced rate. In order to achieve this, as the delivery passage 12 moves into register with an outlet port 13, one of the passages 26 moves into register with the transfer port 27 and with the valve 20 closed and the valve 16 in its first state, as the distributor member rotates, the rollers and therefore the plungers 23, will be moved inwardly as the rollers move off the base circle onto the leading flanks of the cam lobes and fuel will be supplied to the engine. When the required volume of fuel has been supplied at the reduced rate, the valve 20 is opened and the remaining flow of fuel to the engine takes place at a high rate from the accumulator 10 as described above. The further fuel displaced by the high pressure pump flows to the accumulator. When the required total quantity of fuel has been supplied to the engine the valve 16 is actuated to close the port 19 as described above and with the valve 20 open the remaining quantity of fuel which is displaced by the plungers during their inward movement, flows into the accumulator 10. As the plungers move over the crests of the cam lobes the passage 26 moves out of register with the transfer port 27 and a further one of the passages moves into register with the fuel supply port 28 so that the plungers are now urged outwardly their maximum extent by a fresh supply of fuel obtained from the low pressure pump. The cycle is then repeated and the fuel injection rate diagram which is obtained with this arrangement is shown in FIG. 2*a*. The initial rate at which fuel is delivered to the engine is determined by the cam profile and the timing of the start of fuel delivery can be varied by altering the angular setting of the cam ring. The fuel which flows to the accumulator 10 from the high pressure pump 21 may flow through the valve 20 as shown in FIG. 1. However the accumulator may be divided into two sections which are interconnected through an orifice. The valve 20 in this case is modified so that fuel is supplied from one section of the accumulator to the engine and is supplied to the other section of the accumulator by the high pressure pump 21. FIG. 5 shows one way in which this can be achieved. The two sections of the accumulator are shown at 10A and 10B and are interconnected by a restricted orifice 9. The valve 20 is shown as two separate valves 20A and 20B, valve 20A being a two way valve and valve 20B an ON/OFF valve. The valve 20A, has one port connected to the passage 27 and in one position this port is connected through the valve with the accumulator section 10A. In the alternative position the port is connected directly to the port 19 of the valve 16. The valve 20B is connected between the accumulator section 10B and the port 19 of the valve 16. The initial delivery of fuel to the engine takes place from the high pressure pump, by way of the valve 20A and the valve 16, when sufficient fuel has been delivered to the engine at the reduced rate the valves 20A, 20B are moved to their alternative positions and fuel is supplied from the accumulator section 10B to the engine and the fuel delivered by the high pressure pump flows to the accumulator section 10A.

It is necessary to control the pressure in the accumulator and this can be achieved by allowing some of the fuel under pressure in the accumulator to return to the bore 22 whilst the plungers are under the control of the trailing flanks of the cam lobes. This of course requires the valve 20 to remain open and for the passage 26 to remain in communication with the port 27. The port 28 is phased accordingly. A sensor is provided which provides a signal indicative of the pressure in the accumulator and this signal is supplied to a control system for the valve 20 which is closed when the accumulator pressure has fallen to the desired value. The pressure in the passage 27 will then fall to the output pressure of the low pressure pump as fuel is supplied to the bore by way of the port 28.

As an alternative the ports 28 and 27 may be connected by an annular groove which also communicates with the passage 26. In this case a non-return valve is provided in the connection between the port 28 and the outlet of the low pressure pump.

An alternative way of controlling the pressure in the accumulator is to allow the plungers to charge the accumulator after they have supplied fuel at the initial rate, and when the accumulator pressure has reached the desired value, to direct the remaining quantity of fuel delivered by the plungers to the outlet of the low pressure pump. For this purpose the valve 20 is replaced by a valve arrangement which can provide a number of alternative flow sequences as follows:

1. A first sequence in which the passages 26 are connected to the port 19 of the valve 16 to provide the flow of fuel to the engine at the rate determined by the high pressure pump 21.
2. A second sequence in which the accumulator 10 is connected to the port 19 of the valve 16 to effect flow of fuel at the high rate to the engine and simultaneously the fuel displaced by the plungers may be supplied to the accumulator.
3. A third sequence in which the fuel displaced by the high pressure pump is diverted to the low pressure pump because the accumulator pressure has attained the desired value.
4. A fourth sequence in which the connection between the port 15 and the port 19 is broken and port 15 is connected to port 18 as when the desired quantity of fuel has been supplied to the engine and the passages 26 remain connected to the low pressure pump. This allows any further fuel displaced by the plungers to flow to the low pressure pump and also allows the bore 22 to be refilled. In this case the separate supply port 28 may not be provided and assistance in filling the bore 22 obtained by providing the valve 16 with a further position in which the ports 17 and 19 are interconnected, with the port 19 being connected to the passages 26.

FIG. 6 shows the modifications required to obtain the aforesaid sequences. The valve 20 is modified so that it becomes a three way selector valve 40 having an angularly movable valve member 41 which defines a flat 42 which is permanently connected to the transfer port 27.

In addition the valve has three ports 43, 44, 45 which are angularly spaced by 120°. The first port 43 is connected to the accumulator 10, the second port 44 is connected to the port 19 of the valve 16 and the third port 45 is connected to the passage 18 which in this case is connected to the outlet of the low pressure pump.

In the position shown in FIG. 6 the valve 40 connects the transfer port 27 to the port 19 of the valve 16 and this is set to connect the ports 15 and 19 with the result that the fuel displaced by the high pressure pump is supplied to the delivery passage 12 and an outlet 13. The delivery of fuel from the accumulator to the outlet is arranged by moving the valve member 41 angularly so that the flat 42 connects the ports 43 and 44. In this setting the high pressure pump delivers fuel to the accumulator 10. If the valve member 41 is moved so that the flat 42 connects the ports 43 and 45 the pressure in the accumulator can be controlled and this supplies fuel from the high pressure pump flows to the inlet of the low pressure pump.

This system of valves is also applicable in the situation where delivery of fuel to the engine is terminated before the accumulator pressure has achieved the desired value.

The pressure in the accumulator may be controlled by a relief valve (not shown) which is controlled by the control system in response to a pressure signal.

As described a single high pressure pump 21 has been utilised to supply fuel at the low initial rate to the engine and to charge the accumulator 10 with fuel. As an alternative to the high pressure pump described, the distributor member may be axially movable by means of a face cam to pressurise fuel in a chamber defined by the body and the distributor member.

The two roles of charging the accumulator and supplying fuel at a low initial rate can be undertaken by separate high pressure pumps. Each of these pumps may take the form of the high pressure pump shown in FIG. 1 or one of the pumps could be of this type with the other pump being formed by arranging for the distributor member to be axially movable within the body 9 as mentioned above.

For some engine operating conditions it may be required to supply the initial quantity of fuel at a restricted rate using the high pressure pump as described and then to supply the fuel at only a moderately increased rate from the accumulator source. This can be achieved by reducing the pressure of fuel in the accumulator 10. The fuel injection rate diagram appropriate to this arrangement is seen in FIG. *2c*. The fuel pressure in the accumulator can then be increased. Alternatively a second accumulator may be provided in which fuel is stored at the lower pressure and which can be connected to the port 19 and the valve 16 through a valve similar to the valve 20.

Under some conditions of engine operation it may not be necessary to provide for the initial quantity of fuel to be supplied at a restricted rate to the engine and in this case the valve 20 is opened to initiate delivery of fuel to the associated engine at or before the moment when the plungers commence their inward movement. The fuel injection rate diagram which is obtained with this arrangement is shown at FIG. *2e*.

In other engine operating conditions such as idling, it is convenient to derive all the fuel which is supplied to the engine directly from the high pressure pump 21 and the valve 20 is therefore not opened until the valve 16 is switched to its second position to connect the port 15 with the port 17 to terminate delivery of fuel. The accumulator 10 then acts to absorb the remaining fuel displaced by the plungers. The fuel injection rate diagram which is obtained with this arrangement is shown at FIG. *2f*.

As an alternative the accumulator 10 may be isolated and after the valve 16 is operated to terminate delivery of fuel to the engine, the remaining quantity of fuel displaced by the plungers may flow to the drain.

It will be understood that the change in the injection rates takes place in a gradual manner by appropriate operation of the valves or by varying the pressure in the accumulator or by a combination thereof.

For some engine applications so called pilot injection is required i.e. following the delivery of an initial quantity of fuel to the engine there is a gap before the main quantity of fuel is delivered to the engine. This can be achieved by using the valves 16 and 20 to terminate delivery of fuel to the engine from the high pressure pump 21 and to direct the fuel to the accumulator. Valve 16 is then operated when fuel is to be supplied at the high rate from the accumulator. The fuel injection rate diagram which is obtained with this arrangement is shown at FIG. *2d*.

In the arrangement shown in FIG. 3, like reference numerals to those used in FIG. 1 are utilised for corresponding parts and in this arrangement the port 19 of the valve 16 is connected to the accumulator 10 by way of a restrictor 30 and in parallel with the restrictor is an ON/OFF valve 31.

The high pressure pump 21 is utilised only to charge the accumulator 10 and for this purpose the transfer port 27 is connected to the accumulator by way of a non-return valve 32. The pressure within the accumulator may be controlled using a relief valve or alternatively an arrangement may be provided to control the volume of fuel delivered by the high pressure pump. One way of reducing the fuel flow from the high pressure pump is to use a throttle to restrict the rate at which fuel flows into the pump. As an alternative some form of plunger stroke control may be provided.

In operation, prior to the start of fuel delivery the valve 31 is closed and the valve 16 is in the second position in which the ports 15 and 17 are in communication with each other. When the delivery passage has moved into register with an outlet port 13 the valve 16 is moved to its first position in which the ports 15 and 19 are connected together so that fuel can flow from the accumulator 10 to the delivery passage 12. The rate of flow of fuel is controlled by the size of the restrictor 30. When it is deemed that sufficient fuel has been supplied at the restricted rate, the valve 31 is opened to allow fuel flow at a substantially unrestricted rate and when sufficient fuel has been supplied to the engine the valve 16 is moved to its second position so that the flow of fuel from the accumulator is halted and the delivery passage 12 is vented to the drain. Before the next delivery of fuel takes place the valve 31 is closed and the process is repeated with fuel being supplied to the outlets 14 in turn. The high pressure pump 21 is conveniently arranged to charge the accumulator with fuel each time delivery of fuel takes place to the associated engine and the delivery of fuel by the high pressure pump to the accumulator may commence whilst fuel is being supplied to the engine. The fuel injection rate diagram which is obtained with this arrangement is shown at FIG. *2b*.

As an alternative to the restrictor 30 and the ON/-OFF valve 31, a variable lift valve not shown, may be connected intermediate the accumulator 10 and the port 19. In this case the variable lift valve may be utilised to initiate delivery of fuel whilst the valve 16 is in its first position, with the valve 16 being used to terminate delivery of fuel by moving it to its second position.

In the arrangement which is shown in FIG. 4, the high pressure pump 21 is utilised to charge the accumulator 10 by way of a non-return valve 32. As in the example of FIG. 3 a first ON/OFF valve 35 is provided to connect the accumulator 10 to the delivery passage 12 and when this valve is opened fuel flows to the engine at the maximum rate. In order to provide a reduced rate of flow of fuel to the engine a second accumulator 36 is provided in which fuel is stored at a lower pressure and this accumulator can be connected to the passage 12 by way of a second ON/OFF valve 37. A third ON/-OFF valve 38 is provided to connect the delivery passage 12 to a drain. In operation, when the delivery passage 12 registers with an outlet port 13, the valve 38 is closed and the valve 37 opened to allow fuel to flow at a reduced rate to the associated engine because of the lower pressure in the accumulator 36. When sufficient fuel has been supplied at the reduced rate the valve 35 is opened and the valve 37 closed so that the rate of flow of fuel to the engine increases due to the higher pressure in the accumulator 10. Termination of delivery of fuel to the engine is achieved by closing the valve 35 and opening the valve 38. The fuel injection rate diagram which is obtained with this arrangement is shown at FIG. *2b*.

In some instances all the fuel which is supplied to the engine is derived from the accumulator 36 to give the fuel injection rate diagram shown at FIG. *2g*. In other instances at the instant of closure of the valve 37 the valve 38 is opened to terminate delivery of fuel to provide so called pilot injection of fuel and at the appropriate time the valve 38 is closed and the valve 35 opened to provide the main delivery of fuel. This arrangement gives the fuel injection rate diagram as seen in FIG. *2h*.

In order to pressurise the accumulator 36 a separate high pressure pump may be provided. Alternatively the accumulator 36 may be charged from the accumulator 10 by appropriate operation of the valves 35 and 37 preferably during the time when the delivery passage is out of register with an outlet port 14. Individual relief valves may be utilised to control the pressures in the accumulators 10 and 36 or alternatively the pressures particularly in the accumulator 10 may be controlled by appropriate operation of the valves 35 and 38.

We claim:

1. A fuel system for supplying fuel to the injection nozzles in turn of a multi-cylinder compression ignition engine comprising an accumulator in which fuel is stored under pressure, means including a delivery passage for distributing fuel to the injection nozzles in turn, valve means operable to connect said accumulator with said delivery passage when it is required to supply fuel to the engine and pump means for charging the accumulator, said pump means comprising a high pressure pump having a pumping plunger actuated by a cam in timed relationship with the engine, said valve means having a first setting in which the fuel delivered by the pump is directed to the delivery passage so as to deliver fuel to the engine at a reduced rate, and the valve means having a second setting in which the accumulator is connected to the delivery passage to provide an increased rate of fuel delivery to the engine.

2. A fuel system according to claim 1, in which said valve means has a third setting in which the communication of the pump and the accumulator with the delivery passage is broken and the delivery passage is connected to a drain.

3. A fuel system according to claim 2, in which said valve means comprises an ON/OFF valve connected between the high pressure pump and the accumulator and a two way valve having a first port connected to the delivery passage, a second port connected to a point intermediate the high pressure pump and the ON/OFF valve and a third port which is connected to drain.

4. A fuel system according to claim 2, in which the accumulator is divided into first and second sections and said valve means comprises a first two way valve having a first port connected to the high pressure pump, a second port which is connected to the first section of the accumulator and a third port, a second two way valve having a first port connected to the delivery passage, a second port connected to drain and a third port, the third port of the first and second two way valves being connected together and an ON/OFF valve connected between the second section of the accumulator and said third ports.

* * * * *